US005700139A

United States Patent [19]

Rodriguez-Amaya

[11] Patent Number: 5,700,139

[45] Date of Patent: Dec. 23, 1997

[54] FUEL INJECTION PUMP OF THE DISTRIBUTOR TYPE WITH A MAGNETICALLY ACTUATED VALVE MEMBER OF A SWITCHING VALVE CONNECTED TO A LOW-PRESSURE PISTON

[75] Inventor: Nestor Rodriguez-Amaya, Stuttgart, Germany

[73] Assignee: Robert Bosch GmbH, Stuttgart, Germany

[21] Appl. No.: 581,579

[22] PCT Filed: Jun. 18, 1994

[86] PCT No.: PCT/DE94/00695

§ 371 Date: Mar. 15, 1996

§ 102(e) Date: Mar. 15, 1996

[87] PCT Pub. No.: WO95/02760

PCT Pub. Date: Jan. 26, 1995

[30] Foreign Application Priority Data

Jul. 15, 1993 [DE] Germany ..... 43 23 683.9

[51] Int. Cl.[6] ..... F04B 37/00; F02M 41/00

[52] U.S. Cl. ..... 417/462; 123/450; 123/506; 251/129.15; 417/505

[58] Field of Search ..... 417/505, 462; 123/449, 450, 506; 251/129.05, 129.15, 356

[56] References Cited

U.S. PATENT DOCUMENTS

| | | | |
|---|---|---|---|
| 5,228,844 | 7/1993 | Klopfer et al. | 417/462 |
| 5,345,916 | 9/1994 | Amann et al. | 123/450 |
| 5,582,153 | 12/1996 | Dutt et al. | 123/450 |

*Primary Examiner*—Timothy Thorpe
*Assistant Examiner*—Cheryl J. Tyler
*Attorney, Agent, or Firm*—Edwin E. Greigg; Ronald E. Greigg

[57] ABSTRACT

A fuel injection pump of the distributor type which has at least one pump piston driven in a reciprocating stroke motion, a rotating distributor shaft which via a distributor bore upon rotation establishes a communication between the pump work chamber, defined by the pump piston, and an injection nozzle, and a switching valve for metering the fuel injection quantity. To achieve highly stable hydraulics upon opening and closing of the switching valve, a low-pressure piston is connected to the valve member of the switching valve; the low-pressure piston is axially displaceably guided on the low-pressure side of the switching valve, downstream of the outlet of a relief bore, in a wall segment. Preferably, the outer diameter of the low-pressure piston is made to largely approximate the diameter of the seat face of the valve member on the associated valve seat.

6 Claims, 1 Drawing Sheet

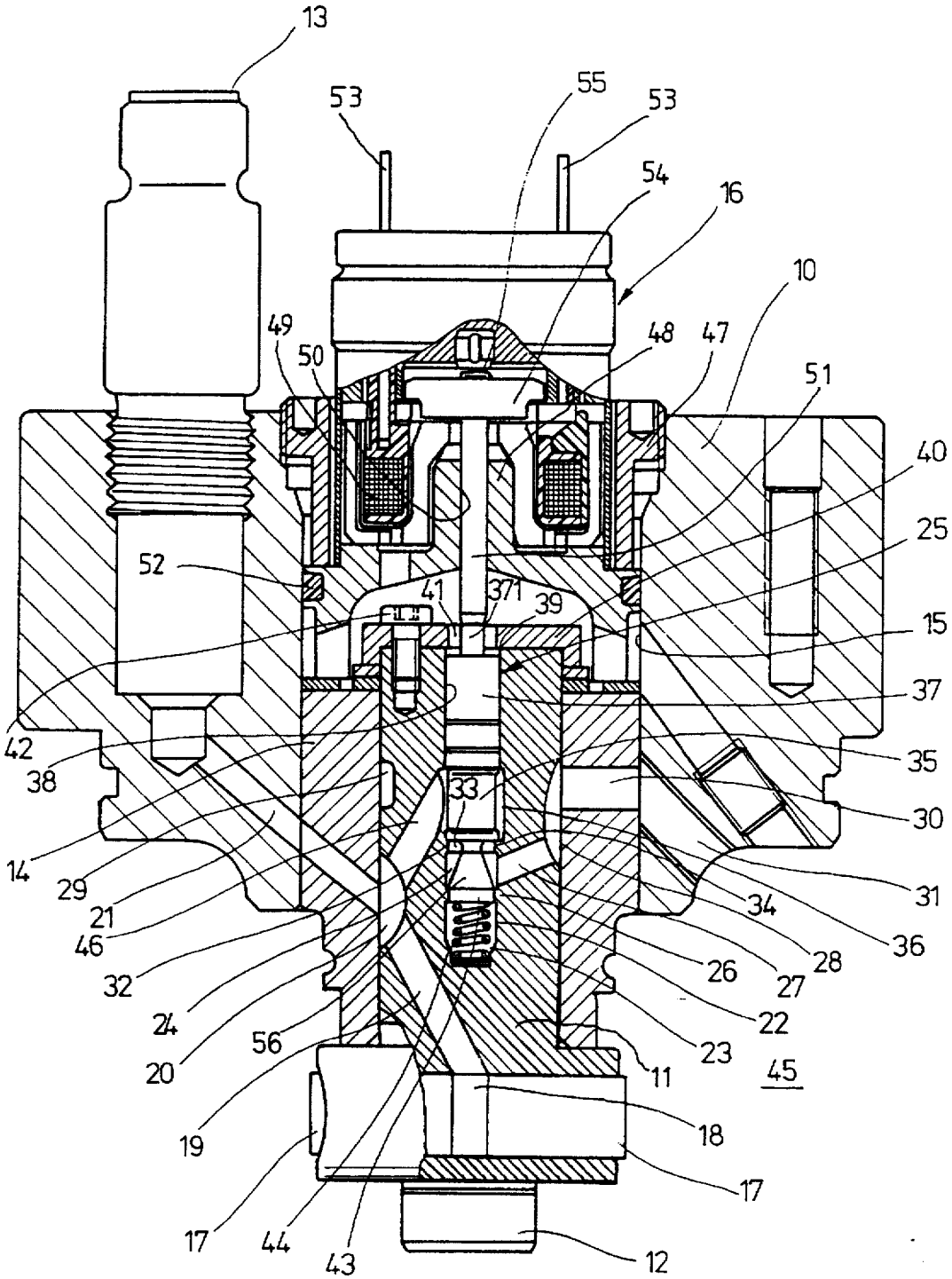
13
53
55
53
54
16
10
49
50
48
47
51
40
25
52
41
371
39
15
37
42
38
35
33
30
14
29
21
46
32
24
20
56
19
17
44
43
34
31
36
28
27
26
22
23
11
45
18
17
12

FUEL INJECTION PUMP OF THE DISTRIBUTOR TYPE WITH A MAGNETICALLY ACTUATED VALVE MEMBER OF A SWITCHING VALVE CONNECTED TO A LOW-PRESSURE PISTON

This application is a 371 continuation of PCT/DE94/00695, filed Jun. 18, 1994.

BACKGROUND OF THE INVENTION

The invention is based on a fuel injection pump of the distributor type.

Fuel injection pumps of this kind with inward-opening switching valves (I-valves), or in other words with a valve member that upon valve opening is to be displaced counter to the fuel flow, have the advantage of operating stability over fuel injection pumps with outward-opening switching valves (A-valves). In such I-valves the operating direction of the valve member and the flow direction of the fuel flow that begins when the valve opens are in the same direction, since unlike the A-valve, the hydraulic pulse forces occurring in the opening operation and oriented oppositely of the fuel flow direction act to reinforce opening, so that brief closing phases in the opening operation and an attendant instability of the switching valve are fundamentally precluded.

Nevertheless, an unstable performance has been found during the injection phase in the opening and closing operation of such I-valves. This instability has the following causes: Before the onset of the injection event, the pump piston pumps fuel from the pump work chamber to the first valve chamber, via the valve opening uncovered by the valve member to the second valve chamber located in the low-pressure region. This pumping is continuous, so that one can say that there is a moving column of fuel. To initiate the injection event, the switching valve is closed, which tears the fuel column apart. Since this fuel column has its own dynamics, it remains in motion and is later braked by the pressure prevailing in the low-pressure region. Before that, however, it creates a void in the second valve chamber below the closed valve member. Subsequently, the braked fuel column is accelerated in the opposite direction in the low-pressure region, or in other words into the previously created void, and the void is then again filled. This creates a filling surge that strikes the end face of the valve member. If the valve member is still in motion at the time, then the motion of the valve member becomes uncontrollable, which leads to an unstable injection event. In a similar way, instabilities arise from opening of the valve member during termination, if at that time pressure pulsations are occurring in the fuel.

British Patent 2 261 035 discloses a distributor fuel injection pump, which has a pumping and distributor piston that is driven to both reciprocate and at the same time rotate in a pump cylinder and that in the pump cylinder on one side defines a pump work chamber that is closed off on the other side by a solenoid valve housing inserted in the housing of the fuel injection pump. Filling and relief of the pump work chamber are done by means of the solenoid valve, which with its valve member makes and breaks the transition from a first valve chamber, acted upon by high pressure and communicating with the pump work chamber, to a second valve chamber communicating with a relief chamber, and thus controls the phase in which the pump piston brings the fuel-filled pump work chamber to a high pressure that is effective for injection. The valve member has a low-pressure-side relief piston and is urged in the opening direction by a valve spring counter to the fuel outflow direction from the pump work chamber and in the closing direction by an electromagnet.

This known embodiment has the disadvantage that because of the solenoid valve adjacent to the pump cylinder, considerable space is needed for the fuel injection pump, and there is also a large idle volume because of the solenoid valve housing and the valve chambers and incoming lines that it contains; this idle volume must be prestressed to injection pressure by the pump piston upon each feed stroke of the pump piston yet is not available actively for injection. Moreover, the entire solenoid valve housing must close off the pump work chamber in a high-pressure-proof manner, which makes for further complication and expense in production and installation.

As a result of the embodiment according to the invention, the required structural space is reduced because the valve member is integrated with the distributor. The expense for adequate high-pressure sealing of the pump work chamber is thus also reduced, since this sealing is taken over by the valve member itself, with its guidance in the axial blind bore of the distributor. The electromagnet that actuates the valve member is thus now exposed only to an outflow of leaking fuel and need not be constructed, manufactured and installed in a manner that is proof against high pressure.

Although European Patent Disclosure EP-A-0 244 340 discloses disposing a valve member inside a central blind bore of a distributor of a distributor-type fuel injection pump, nevertheless in this valve the second valve chamber is located outside the distributor, and it also lacks a low-pressure relief piston. The known fuel injection pump has the disadvantages already discussed at the outset.

ADVANTAGES OF THE INVENTION

The fuel injection pump according to the invention has the advantage that as a result of the low-pressure piston disposed in the low-pressure region, the valve member remains essentially unaffected by pressure pulsations described, and as a result stable hydraulics are assured, both upon initiation of the injection event by closure of the switching valve and upon termination of the injection event by opening of the switching valve.

By means of the low-pressure piston, the engagement face on the valve member for the pressure pulsations is greatly reduced in area, since the entire cross section of the valve member, defined by the valve seat diameter, is no longer available as an engagement face; instead, only the annular cross-sectional area that results from the difference between the seat diameter of the valve member and the diameter of the low-pressure piston is available as an engagement face. If the diameter of the low-pressure piston is made to approach the seat diameter, the influence of the pressure pulsation is eliminated, and the valve member motion on opening and closing is stable.

As a result of the provisions recited in the other claims, advantageous further features of and improvements to the fuel injection pump disclosed are possible.

BRIEF DESCRIPTION OF THE DRAWING

The invention is described in detail in the ensuing description in terms of an exemplary embodiment shown in the drawing. The drawing in fragmentary fashion shows a longitudinal section through a fuel injection pump of the distributor type for a Diesel engine.

DESCRIPTION OF THE EXEMPLARY EMBODIMENT

The distributor-type fuel injection pump shown in fragmentary fashion in longitudinal section in the drawing has a housing, not visible here, which is closed off in liquid-tight fashion by a housing cap 10. A distributor shaft 11 is rotatably supported in the housing cap 10. In the housing cap 10, connecting tubes 13 are disposed at a plurality of pump outlets; via pressure lines and injection nozzles, not shown, they supply a multicylinder Diesel engine. Only one of the connecting tubes 13 is shown. The connecting tubes 13 are supplied in succession, via the rotating distributor shaft 11, with a metered quantity of fuel which is at injection pressure and which is injected, via the respective connecting tube 13 and the pressure line and injection nozzle connected to it, into the combustion chamber of the particular cylinder of the Diesel engine. The distributor shaft 11 is rotatably supported in a sleeve 14, which is inserted into a bore 15 in the housing cap 10. The bore 15 is closed off at the face end by an electromagnet 16. The distributor shaft 11 is connected by means of a driver 12 in a manner fixed against relative rotation to a drive shaft, not shown in further detail, whose axis is in alignment with that of the distributor shaft 11.

In the lower collar portion, formed with a larger diameter, of the distributor shaft 11 as seen in the drawing, pump pistons 17 are provided, which may be two, three or four in number, and which are each axially displaceably guided in a pump cylinder, which is preferably integral with the distributor shaft 11 and is oriented crosswise to the distributor shaft axis or in other words radially. Of the pump pistons 17, only two pump pistons 17 are suggested in the drawing. The pump pistons 17 revolving with the distributor shaft 11 are each driven to perform a reciprocating stroke motion in the pump cylinder via a tappet, which is supported on a stationary cam ring with a cam race formed on it. As shown for one pump piston 17 in the drawing, each pump piston 17 defines a pump work chamber 18, which communicates, over a predetermined rotational angle range of the distributor shaft 11, with a distributor bore 19 made in the distributor shaft 11. The distributor bore 19 discharges into an annular groove portion 20 on the circumference of the distributor shaft 11, which during this rotational angle range of the distributor shaft 11 communicates on the inside wall of the sleeve with the mouth of an injection bore 21 leading to the connecting tube 13.

A coaxial blind bore 22 is made in the distributor shaft 11, and a plurality of bore segments of different diameters are embodied in it. The bore segment located at the bottom of the blind bore 22 forms a leakage fluid collecting chamber 23, and the ensuing bore segment forms a second valve chamber 24 for a switching valve 25. The leakage fluid collecting chamber 23 and the second valve chamber 24 are separated from one another by a cylindrical wall segment 26 whose inside diameter is somewhat reduced. The leakage fluid collecting chamber 23 is connected to a fuel return line, not visible here. The second valve chamber 24 communicates, via a relief bore 27 extending to the outside in the distributor shaft 11 and an axial groove 28 made on the circumference of the distributor shaft 11, with an annular groove 29 disposed on the circumference of the distributor shaft 11 and communicating continuously with the mouth of a radial bore 30 in the sleeve 14. The radial bore 30 communicates via a bore 31 in the housing cap 10 with the interior 45 of the fuel injection pump, which is filled with fuel by means of a fuel feed pump, not shown here but mounted on the drive shaft, and from which upon each pump piston stroke, fuel is pumped into the pump work chamber 18. Adjoining the second valve chamber 24 in the blind bore 22 is a radially protruding annular rib 32, which defines a valve opening 33 of the switching valve 25 and on whose annular face remote from the second chamber 24 a valve seat 34 is formed for a valve member 35. The bore segment preceding the valve opening 33 in the blind bore 22 and having a larger inside diameter forms a first valve chamber 36 of the switching valve 25, in which the valve member 35 that cooperates with the valve seat 34 to open and close the valve opening 33 is disposed. The first valve chamber 36 is connected to the annular groove segment 20 via a connecting bore 46 leading to the outside in the distributor shaft 11, and thus during the defined rotational angle range of the distributor shaft 11 communicates both with the pump work chamber 18 and with the injection bore 21.

The valve member 35 is embodied integrally with a guide piston 37, which is axially displaceably guided in a guide segment 38 preceding the first valve chamber 36 and having a reduced diameter compared with that chamber. The guide piston 37 rests with its end remote from the valve member 35 on a stop 39, which is formed by a cap 40, which is mounted on the face end of the sleeve 14 and has a central through bore 41. The cap 40 is secured by means of screws 42 screwed into the face end of the distributor shaft 11. On the side of the valve member 35 remote from the guide piston 37, a conical tang 56 extends onward in one piece; its diameter increases as the distance from the valve member 35 increases, and a low-pressure piston 43 is integrally formed onto its end. The low-pressure piston 43 is located in the cylindrical wall segment 26 formed between the second valve chamber 24 and the leakage fluid collecting chamber 23 and is guided with slight radial play in that segment. The outside diameter of the low-pressure piston 43 is dimensioned to be approximately as large as the seat diameter of the valve member 35 by which the valve member 35 is seated on the valve seat 34. This seat diameter, in the cylindrical embodiment shown of the valve member 35, is approximately equivalent to the inside diameter of the valve opening 33. A valve spring 44 embodied as a cylindrical helical compression spring is received in the leakage fluid collecting chamber 23 and is braced against the bottom of the blind bore 22 and the face end of the low-pressure piston 43. The valve spring 44 acts in the opening direction of the switching valve 25 and tends to lift the valve member 35 from the valve seat 34, thus uncovering the valve opening 33. In the valve opening position, the guide piston 37 rests on the stop 39 on the cap 40, under the influence of the valve spring 44.

The electromagnet 16 mentioned at the outset serves to close the switching valve 25 counter to the restoring force of the valve spring 44.

In a known manner, the electromagnet 16 has a cup-shaped magnet housing 47, with a central cup core 48 protruding at right angles from the cup bottom. The magnet housing 47 is inserted into the face end of the bore 15 in the housing cap 10 and is sealed off from the bore wall by a ring seal 52. The magnet housing 47 serves at the same time to fix the sleeve 14 axially nondisplaceably in the bore 15. An exciter coil 49 is received in the magnet housing 47; its electrical supply is provided via terminal pins 53. An actuating tappet 51 is axially displaceably guided in a coaxial guide bore 50 in the cup core 48; it is secured by one end to an armature plate 54 of the electromagnet 16 and rests with its other free end on the face end on the guide piston 37, specifically on a reduced-diameter tang 371 of the guide piston 37 that protrudes through the through bore 41 in the cap 40.

When the exciter coil 49 is without current and thus the electromagnet 16 is unexcited, the valve spring 44, via the valve member 35 with the low-pressure piston 43 and guide piston 37, slides the actuating tappet 51 and armature plate 54 against the stop 55 on the magnet housing 47 that defines the maximum stroke of the armature plate 54. The switching valve 25 is opened, and the first valve chamber 36 communicates with the second valve chamber 24 via the valve opening 33. In the open position of the switching valve 25, both the pump work chamber 18, via the distributor bore 19, and the injection bore 21, via the connecting bore 46 in the distributor shaft 11 and via the relief bore 27, and the radial bore 30 and the bore 31 in the housing cap 10 all communicate with the fuel-filled interior 45 of the fuel injection pump. If the exciter current 49 of the electromagnet 16 is supplied with electrical current, then the armature plate 54 is attracted toward the cup bottom of the magnet housing 47 and via the actuating tappet 51 presses the valve member 35 against the valve seat 34 surrounding the valve opening 33. The valve opening 33 is closed, and the pump work chamber 18 communicates with the injection bore 21 via the distributor 19, so that the fuel, compressed to injection pressure in the pump work chamber 18, is injected into the combustion chamber of the cylinder of the Diesel engine via the connecting tube 13 and the pressure line and injection nozzle, not shown. For ending the injection event, the switching valve 25 is deprived of excitation; the armature plate 54 drops away, and the valve spring 44 opens the switching valve 25; the direction of motion of the valve member 35 is counter to the flow direction of the fuel which when the switching valve 25 is open flows from the first valve chamber 36 via the valve opening 33 to the second valve chamber 24 and from there on into the interior 45 of the fuel injection pump. Thus in the manner described, the pump work chamber 18 communicates with the low-pressure region in the interior 45 of the fuel injection pump, and the pressure at the pressure line and injection nozzle drops suddenly, and as a consequence the injection nozzle closes. The injection event is thus discontinued abruptly.

The injection is not limited to the exemplary embodiment described above. For instance, the valve seat 34 and the valve member 35 can both be embodied conically. The diameter of the seat face of the valve member 35 is then determined by the circle of contact of the conical face of the valve member 35 with the conical face of the valve seat 34. The outer diameter of the low-pressure piston 43 is again made to be close to this diameter of the conical seat face of the valve member 35 on the conical valve seat 34.

The foregoing relates to preferred exemplary embodiments of the invention, it being understood that other variants and embodiments thereof are possible within the spirit and scope of the invention, the latter being defined by the appended claims.

I claim:

1. A fuel injection pump of the distributor type for supplying at least one injection nozzle of an internal combustion engine, comprising, at least one pump piston (17), driven in a reciprocating stroke motion, which defines a pump work chamber (18) that is connected to a fuel inlet and upon each pumping stroke, pumps fuel at injection pressure to one of the plurality of injection nozzles; a rotating distributor shaft (11), which upon its rotation, via a distributor bore (19), establishes a communication between the pump work chamber (18) and the plurality of injection nozzles; and having a switching valve (25) for metering the fuel injection quantity, a valve member (35) which controls a valve opening (33), a valve seat (34) between a first valve chamber (36) that communicates with the distributor bore (19), and a second valve chamber (24) that communicates with a relief bore (27), said valve member lifted away from the valve seat (34) by means of a valve spring (44) acting in the valve opening direction and is displaced upon valve opening counter to the flow of fuel flowing out via the valve opening (33), further comprising an electromagnet (16) with a magnet armature (54) for actuating the valve member (35) in the valve closing direction, and a low-pressure piston (43) coaxial with the valve member (35) is rigidly connected to said valve member via a reduced-diameter tang (56), which protrudes into the second valve chamber (24) and is axially guided with minimal radial play, by its end remote from the valve opening (33), in a cylindrical wall segment (26) adjoining the second wall chamber (24), the valve spring (44) is received in a leakage fluid collecting chamber (23) connected to a fuel return line, which has a spring on its face end adjoining the low-pressure piston (43) following the cylindrical wall segment (26), where one end of the spring is braced against the bottom of the leakage fluid collecting chamber (23) and with another end against the face end of the low-pressure piston (43), and the two valve chambers (36, 24), the valve opening (33) with the valve seat (34), and the cylindrical wall segment (26), as well as the leakage fluid collecting chamber (23) together with the valve member (35) and the low-pressure piston are embodied in a central blind bore (22) in the distributor shaft (11), which blind bore is closed from an outside by the valve member, and the magnet armature (54) of the electromagnet (16) comes to act upon an outward-pointing face end of the valve member (35).

2. The fuel injection pump according to claim 1, in which the electromagnet (16) has an exciter coil (49) and an actuating tappet (51) having a permanently connected magnet armature (54) and coaxial with the distributor shaft (11), said tappet rests coaxially on a face end of a guide piston (37) permanently connected to the valve member (35), and that the guide piston (37) rests axially displaceably in a cylindrical guide segment (38) preceding the first valve chamber (36) in the blind bore (22).

3. The fuel injection pump according to claim 2, in which the distributor shaft (11) rests rotatably in a sleeve (14) retained in a pump housing (10); the distributor shaft (11), has an annular groove (29) on its circumference into which the relief bore (27) in the distributor shaft (11) discharges; and that the annular groove (29) always communicates with a mouth of a radial bore (30) made in the sleeve (14), which radial bore communicates with a fuel-filled interior (45) of the pump housing.

4. The fuel injection pump of claim 1, in which a guide piston (37) is permanently connected to the valve member and is forced into contact with a stop (39) that is formed by a cap (40) secured to a face end of the distributor shaft, said cap is supported on a face end of a sleeve (14) that receives the distributor shaft and is permanently disposed in a housing cap of the fuel injection pump, and on another end remote from a face end of the cap (40), the distributor shaft has a collar for receiving pump pistons (17) in pump cylinders oriented radially to an axis of the distributor shaft (11), between the collar and the cap (40) the distributor shaft (11) is axially guided on the sleeve (14).

5. The fuel injection pump of claim 2, in which a guide piston (37) is permanently connected to the valve member and is forced into contact with a stop (39) that is formed by a cap (40) secured to a face end of the distributor shaft, said cap is supported on the face end of a sleeve (14) that receives the distributor shaft and is permanently disposed in the housing cap of the fuel injection pump, and on another end remote from this face end, the distributor shaft has a collar for receiving pump pistons (17) in pump cylinders oriented radially to the axis of the distributor shaft (11), between the collar and the cap (40) the distributor shaft (11) is axially guided on the sleeve (14).

6. The fuel injection pump of claim 3, in which a guide piston (37) is permanently connected to the valve member and is forced into contact with a stop (39) that is formed by a cap (40) secured to a face end of the distributor shaft, said cap is supported on the face end of a sleeve (14) that receives the distributor shaft and is permanently disposed in the housing cap of the fuel injection pump, and on another end remote from this face end, the distributor shaft has a collar for receiving pump pistons (17) in pump cylinders oriented radially to the axis of the distributor shaft (11), between the collar and the cap (40) the distributor shaft (11) is axially guided on the sleeve (14).

* * * * *